United States Patent [19]

Baumann et al.

[11] 4,148,442

[45] Apr. 10, 1979

[54] DEVICE FOR DISPENSING SHEETS OF WEB MATERIAL OF PREDETERMINED LENGTH

[75] Inventors: Manfred Baumann; Walter Besserer, both of Diepoldsau, Switzerland

[73] Assignee: Apura GmbH, Mainz-Kostheim, Fed. Rep. of Germany

[21] Appl. No.: 897,454

[22] Filed: Apr. 18, 1978

[30] Foreign Application Priority Data

Apr. 19, 1977 [CH] Switzerland ..... 004860/77

[51] Int. Cl.[2] ..... A47K 10/38

[52] U.S. Cl. ..... 242/55.3; 242/58

[58] Field of Search ..... 242/55, 53, 55.3, 58; 312/39, 40, 41

[56] References Cited

U.S. PATENT DOCUMENTS 3,628,743 12/1971 Bastian ..... 242/55.3

3,917,191 11/1975 Graham, Jr. et al. ..... 242/55.53

*Primary Examiner*—George F. Mautz

*Attorney, Agent, or Firm*—Sughrue, Rothwell, Mion, Zinn and Macpeak

[57] ABSTRACT

A device for dispensing web material, particularly paper towel material, in a series of sheets has means for carrying first and second rolls of the material. A pivotally mounted lever is retained against resilient bias by the presence of the web from the first roll and released after consumption of the web from the first roll to carry the tail end of the web from the first roll into frictional engagement with the leading end of the web from the second roll in a nip formed between a backing roller and a roller carried on the lever.

5 Claims, 4 Drawing Figures

DEVICE FOR DISPENSING SHEETS OF WEB MATERIAL OF PREDETERMINED LENGTH

BACKGROUND OF THE INVENTION

This invention relates to a device for dispensing pieces of paper of predetermined length, more particularly paper hand towels, comprising means for carrying a first roll of paper and a second replacement roll of paper, a sensor arranged to sense the web of paper from the first roll, and a device which is connected to the sensor and which, immediately after the first roll of paper has been used up, causes the paper delivery to change over to the replacement roll.

The conventional devices for dispensing pieces of paper, e.g. paper towel dispensers, have only one supply roll of paper. When this has been used up, the attendant must immediately insert a new roll to keep the dispenser in operation.

Attention is thus required at specific times which cannot be accurately predicted, for the insertion of a new roll of paper; and this is relatively uneconomic and also does not provide sufficient guarantee that paper will always be available for a user of the dispenser. This is a disadvantage of paper roll dispensers in comparison with the dispensers in which folded pieces of paper are stacked one upon the other.

To alleviate the above problems it is already known to provide a replacement paper roll in the device, such replacement roll automatically delivering pieces of paper after the first roll has been used up. In this way the interval before the device requires attention is increased while such attention can be given at specific intervals of time without the dispenser being out of operation.

Known devices of this kind have various disadvantages which inhibit reliable and economically viable use. For example, the device disclosed in U.S. Pat. No. 3,288,387 requires specially constructed cores for the paper rolls. In addition, the sensor and the device for supplying the leader of the replacement roll to the paper feed system (a gap between a feed roller and a backing roller) have a relatively complicated construction, which is therefore liable to give trouble, so that operational reliability is not adequate. In addition, the relatively complicated procedure for the replacement of the paper rolls requires trained and therefore costly staff.

In the device disclosed in U.S. Pat. No. 3,917,191, there is only relatively little space available for the first paper roll. Since, when a paper roll is replenished during servicing, the replacement roll already in use has to be moved to the position provided for the first roll, and the fresh roll has to be placed in the position provided for the replacement roll, the device can be re-filled only after some of the replacement roll has been used up. This means that the time available for refilling is reduced, with an adverse effect on the economics of the device. In addition, in this known device the supply of the replacement paper leader to the paper feed device (a gap between a feed roller and the backing roller) is again relatively complicated and liable to give trouble, so that operational reliability is not adequate.

The object of this invention is to alleviate the disadvantages of the known devices and provide a device which is of simple construction and easy to service; and in which the replacement paper roll leader can be reliably fed to the paper feed device after the first paper roll has been used up.

SUMMARY OF THE INVENTION

Accordingly, the present invention provides a device for dispensing sheets of predetermined length from a roll of web material such as paper, comprising a housing having an outlet for the web material including means for separating the web into sheets, means for rotatably mounting a first roll of the web material in the housing, means for guiding web material from that first roll along a path in the housing to said outlet, means for rotatably mounting a second roll of the web material in the housing, a backing roller mounted in the housing to guide web material from that second roll to lie adjacent that path, a sensor lever pivotally mounted in the housing and having a sensor element thereon adapted to engage the web material from the first roll at a point in said path, and having a pressure roller positioned thereon to engage the backing roller, and resilient bias means arranged to urge the sensor lever to carry the pressure roller into engagement with the backing roller. The arrangement is such that web material from the first roll engages the sensor element to retain the lever against the action of said bias means with the pressure roller spaced from the backing roller. When the end first roll becomes empty, however, the lever is released to pivot under the influence of said bias means to carry by means of the pressure roller the tail end of the web from the first roll into frictional engagement with the web from the second roll against the backing roller.

When the supply of paper from the first roll comes to an end, the sensor element is no longer in contact with the paper so that the lever is pivoted by the spring-biasing system and the pressure roller is pressed against the backing roller. The second or replacement paper roll leader has previously been introduced into the open gap between the pressure roller and the backing roller, through which gap the path of the web of paper from the first roller also passes, and when the pressure roller is pressed against the backing roller the end portion of the first paper web and the leader of the replacement paper web are pressed together and fed jointly by friction to the outlet. This results in a continuous and absolutely reliable changeover from the first roll to the replacement roll. The device according to the invention is of extremely simple construction and provides a compact system. In addition, a new roll of paper can be inserted at any time between the start and finish of the replacement paper roll and this simplifies attention to the device. Insertion of a new paper roll at the position provided for the replacement roll and the shifting of the existing replacement roll in use to the position provided for the first roll is very simple if the spring-biased lever is mounted on a pivotable housing cover.

In one advantageous embodiment of the invention, the sensor element of the device according to the invention is constructed in toothed form, a support for guiding the web of paper, being provided level with the sensor element and having a complementary toothed form. As a result, the sensor contact pressure does not deflect the web from its proper path in the housing.

BRIEF DESCRIPTION OF THE DRAWINGS

Other advantages, features and applications of the invention will be apparent from the following description of an exemplary embodiment with reference to the accompanying drawings in which.

DESCRIPTION OF PREFERRED EMBODIMENT

Figure 1:
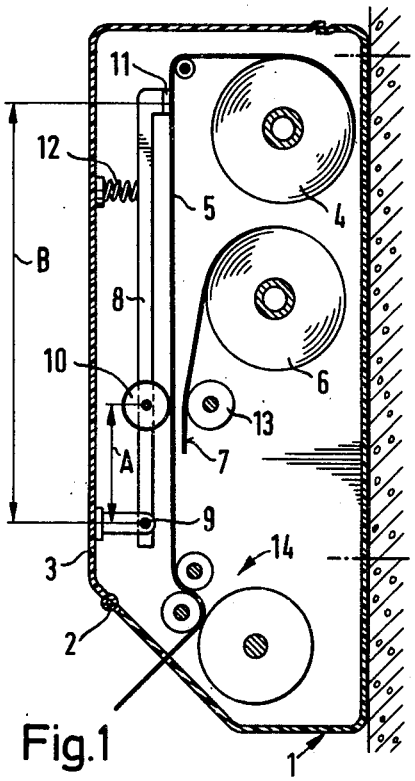
FIG. 1 is a cross-section through a device according to the invention.

FIG. 1 shown a dispenser comprising a housing 1 preferably formed of suitable plastics material with a cover 3 adapted to open by pivoting downwards about a pivot 2. The housing 1 contains a first roll of paper 4 with the paper web lead out of the housing as indicated at 5, and a replacement paper roll 6 with a leader 7, the roll 6 being disposed beneath roll 4. Means is provided in known manner per se for guiding the web 5 down along a generally vertical path through the housing from the roll 4 to the outlet from the housing, where a user may pull the web out for use. A substantially vertical lever 8 is mounted on the inside of the cover 3 to be pivotable about a pivot axis 9. A pressure roller 10 is mounted on the lever 8 with a short lever arm length A about the pivot axis 9. A sensor device 11 is disposed at the top end of the lever 8 with a long lever arm length B about the pivot axis 9. A compression spring 12 is provided between the cover 3 and the lever 8. A backing roller 13 is provided in the housing 1 level with the pressure roller 10. A delivery and cutting device indicated at 14 for cutting or perforating the paper web into sheets as it is pulled out by a user, is shown diagrammatically in the bottom part of the housing 1 and is not the subject matter of this invention being of known type per se, and is therefore not illustrated and described in detail.

Figure 2:
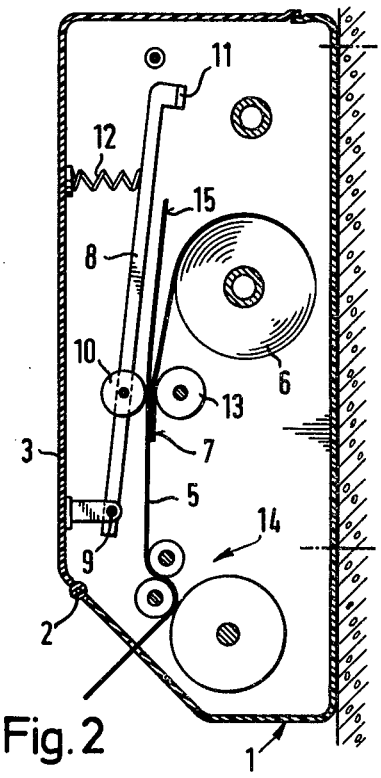
FIG. 2 is a cross-section corresponding to FIG. 1 showing the changeover of the paper delivery from the first roll to the replacement roll.

The apparatus operates as follows: The web 5 from the first roll 4 of paper is first used sheet by sheet as cut off by the device 14 in conventional manner. In this condition the sensor 11 is in contact with the paper web 5, and the pressure roller 10 and the backing roller 13 are thus spaced apart during this period. The paper web 5 passes unrestrained through the open gap between the two rollers 10 and 13. The leader 7 of the replacememt paper roll 6 is also introduced into this open gap (see FIG. 1) when the replacement roll is initially put in the dispenser. When the end 15 of the web 5 leaves the first roll, the lever 8 is allowed to be pivoted in a clock-wise direction by the pressure of the spring 12. When this happens, the pressure roller 10 is pressed against the backing roller 13, so that the end 15 of the web 5 from the first paper roll 4 and the leader 7 of the replacement roll 6 are pressed together, as will be seen in FIG. 2. On further pulling of the web 5 from the first roll 4 by a user of the machine, the leader 7 of the replacement roll 6 is thus pulled down simultaneously with the end 15 of the web 5 by friction, so that there is an undisturbed and continuous changeover from the first roll 4 to the replacement roll 6.

Figure 3:
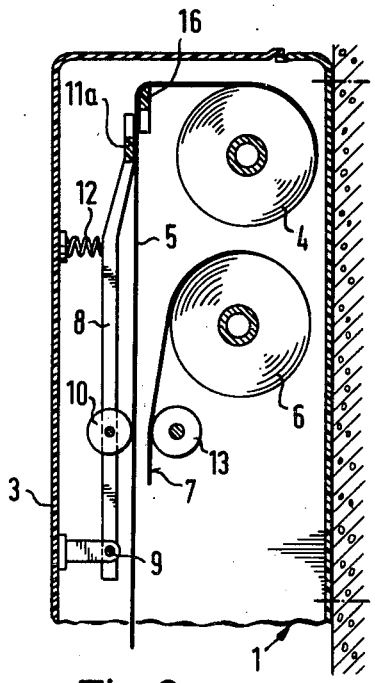
FIG. 3 is a partial section corresponding to FIG. 1 showing a sensor of special construction.
Figure 4:
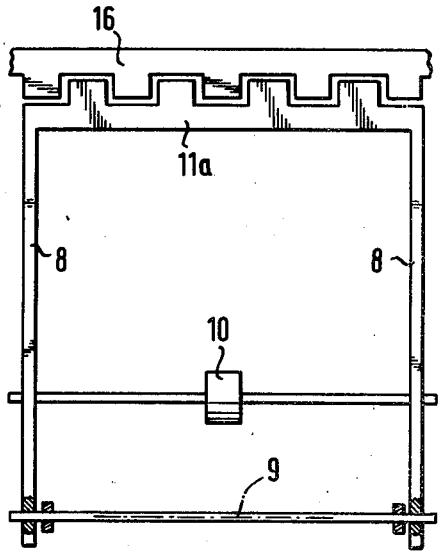
FIG. 4 is a front elevation of the lever of the device shown in FIG. 3.

FIGS. 3 and 4 show an alternative toothed or rake-like sensor 11*a* which co-operates with a toothed or rake-like web support 16, constructed to complement the teeth of the sensor. This rake-like construction of the sensor 11*a* and of the support 16 reliably prevents any distortion in the path of the paper web 5 as a result of the contact pressure exerted by the sensor on the paper, and prevents the lever 8 from pivoting until the tail end of the web from the first roll 4 has passed over the support 16.

What is claimed is:

1. A device for dispensing sheets of predetermined length from a roll of web material such as paper, comprising:

(a) a housing having an outlet for the web material including means for separating the web into sheets, (b) means for rotatably mounting a first roll of the web material in the housing, (c) means for guiding web material from that first roll along a path in the housing to said outlet, said path including a generally vertical portion, (d) means for rotatably mounting a second roll of the web material in the housing disposed below said means for mounting the first roll, (e) a backing roller mounted in the housing below the means for mounting the second roll to guide web material from the second roll to lie adjacent said path, (f) a sensor lever pivotally mounted in the housing and having a sensor element thereon adapted to engage the web material from the first roll at a point in said path, and having a pressure roller positioned thereon to engage the backing roller, said lever extending generally vertically alongside the generally vertical portion of said path and (g) resilient bias means arranged to urge the sensor lever to carry the pressure roller into engagement with the backing roller;

whereby web material from the first roll engages the sensor element to retain the lever against the action of said bias means with the pressure roller spaced from the backing roller; and when the first roll becomes empty the lever is released to pivot under the influence of said bias means to carry by means of the pressure roller the tail end of web from the first roll into frictional engagement with web from the second roll against the backing roller.

2. A device according to claim 1, wherein said lever is pivotally mounted on a wall of said housing, and said resilient bias means comprises a compression spring mounted between the lever and said wall.

3. A device according to claim 2, wherein said wall is formed as part of a cover which is pivotally mounted on the housing to afford access to the inside.

4. A device according to claim 1, wherein said sensor element has a toothed form, and a web support of complementary toothed form is provided in the housing adjacent the sensor element to support the web from the first roll in said path.

5. A device according to claim 1, wherein the pivot axis of said lever is disposed below the means for mounting the second roll.

* * * * *